United States Patent [19]

Trappmann et al.

[11] Patent Number: 4,460,311

[45] Date of Patent: Jul. 17, 1984

[54] APPARATUS FOR MINIMIZING AND MAINTAINING CONSTANT THE BLADE TIP CLEARANCE OF AXIAL-FLOW TURBINES IN GAS TURBINE ENGINES

[75] Inventors: Klaus Trappmann, Dachau; Wolfgang Krüger, Reichertshausen, both of Fed. Rep. of Germany

[73] Assignee: MTU Motogren-Und Turbinen-Union, Munich, Fed. Rep. of Germany

[21] Appl. No.: 265,849

[22] Filed: May 21, 1981

[30] Foreign Application Priority Data

May 24, 1980 [DE] Fed. Rep. of Germany ..... 3019920

[51] Int. Cl.[3] ..... F01D 11/08

[52] U.S. Cl. ..... 415/116; 415/174; 415/180; 415/197

[58] Field of Search ..... 415/116, 172 A, 174, 415/177, 178, 180, 196, 197, 170 R, 172 R, 200; 403/28, 179, 404, 408; 411/904

[56] References Cited

U.S. PATENT DOCUMENTS

| | | | |
|---|---|---|---|
| 2,144,417 | 1/1939 | Schneible | 415/197 X |
| 2,402,841 | 6/1946 | Ray | 415/175 X |
| 3,243,158 | 3/1966 | Desmond | 415/9 |
| 3,502,596 | 3/1970 | Sowards | 415/174 |
| 3,514,112 | 5/1970 | Pettengill, Jr. | 277/53 X |
| 3,813,185 | 5/1974 | Bouiller et al. | 415/172 A X |
| 3,825,364 | 7/1974 | Halila et al. | 415/174 X |
| 3,880,435 | 4/1975 | Thornbald | 415/174 X |
| 3,975,165 | 8/1976 | Elbert et al. | 415/174 X |
| 4,135,851 | 1/1979 | Bill et al. | 415/174 |
| 4,273,824 | 6/1981 | McComas et al. | 415/200 X |
| 4,295,787 | 10/1981 | Landellier | 415/174 X |

FOREIGN PATENT DOCUMENTS

| | | | |
|---|---|---|---|
| 1112897 | of 1961 | Fed. Rep. of Germany | 415/197 |
| 0263966 | 1/1927 | United Kingdom | 415/172 A |
| 0851323 | of 1960 | United Kingdom | 415/174 |
| 0851267 | of 1960 | United Kingdom | 415/174 |
| 0903824 | 8/1962 | United Kingdom | 403/179 |

*Primary Examiner*—Harvey C. Hornsby
*Assistant Examiner*—Christine A. Peterson
*Attorney, Agent, or Firm*—Posnack, Roberts, Cohen & Spiecens

[57] ABSTRACT

Apparatus and method for minimizing and maintaining substantially constant the effective blade tip clearance between the outer free ends of rotor blades and an adjacent casing shroud of an axial-flow turbine of a gas turbine engine. The casing shroud includes a portion facing the hot gas stream and the outer rotor blade ends and a packing of high heat-resistance, high erosion-resistance ceramic elements secured to the shroud via a metal ring to face the blade tips. A heat insulator is interposed between the packing and the metal ring. A perforated conduit is mounted outside the metal ring for blowing cooling fluid against the metal ring on the side thereof remote from the insulator for equalizing the expansion of the metal ring to that of the turbine wheel. The ceramic packing includes projections facing the outer ends of the blades which are tapered so that they are easily broken off when coming into contact with the blades during running-in of the apparatus.

20 Claims, 10 Drawing Figures

APPARATUS FOR MINIMIZING AND MAINTAINING CONSTANT THE BLADE TIP CLEARANCE OF AXIAL-FLOW TURBINES IN GAS TURBINE ENGINES

FIELD OF THE INVENTION

This invention relates to apparatus for minimizing and maintaining constant the effective blade tip clearance between the outer free ends of the blades of a rotor wheel and an adjacent casing shroud in axial-flow turbines of gas turbine engines.

BACKGROUND

The rotor wheels of axial-flow turbines are surrounded by a shroud-like stationary component adapted to maintain a narrow gap or clearance with the rotor blade tips under all operating conditions over long periods of service in order to achieve consistently high turbine efficiencies.

The requirements imposed on the casing shrouds of modern gas turbine engines towards this end are the following:

- the diameter of the casing shroud must be adapted to the expansion of the rotor wheel, which varies with operating conditions; and
- the surface of the gas-wetted inner surface of the casing shroud must be erosion and corrosion resistant and must have adequate running-in or breaking-in properties to prevent abrasive wear on the rotor blade tips when, for example, the rotor wheel is in locally rubbing contact as a result of high loading.

Satisfying these requirements becomes increasingly difficult, with conventional casing shroud designs, at increased gas temperatures: the need for high flows of cooling air impairs the efficiency, and the requirements for adequate erosion and corrosion resistance of the hot gas wetted surface are incompatible, in practice, with the requirements for good running-in properties.

SUMMARY OF THE INVENTION

An object of the present invention is to provide apparatus associated with axial-flow turbines which eliminates the difficulties in the prior art constructions discussed above and specifically which minimizes and maintains constant the turbine rotor blade tip clearance in gas turbine engines over a maximally wide operating range and also in transient operating conditions.

A further object of the invention is to provide such apparatus which is relatively easy to manufacture and install.

Another object of the invention is to provide such apparatus in which good running-in properties are achieved.

In accordance with the present invention, the gas wetted inner surface of the casing shroud is provided with a packing of elements of a highly heat-resistant, corrosion and erosion-resistant ceramic material secured to a metal ring of the shroud. Highly efficient heat insulation layers and minimum contact areas between the metal ring and the ceramic elements restrict the flow of heat to the ring and thereby minimize the requirement for cooling air.

In order to adapt the metal ring to the expansion of the rotor wheel, the temperature (and thus the expansion) of the metal ring is controlled conventionally by blowing air of a suitable temperature against the ring.

The ceramic elements associated with the metal ring follow the expansion of the metal ring, ensuring a consistently narrow blade tip clearance. The clearances expected to occur in operation between the various ceramic elements (which when cold are closely packed) as a result of the differential thermal expansions of metal and ceramic will cause little if any appreciable leakage losses.

The ceramic material has a very hard surface, thus meeting the requirement for high resistance to erosion. Adequate running-in properties are achieved by utilizing the great brittleness of the ceramic material. Namely, those ends of the ceramic elements which face the rotor blade tips are feathered or tapered in knife-like fashion, and in the running-in process the rotor blades knock off the knife edges to the running-in depth without suffering abrasive wear themselves.

Further objects and advantages of the present invention will be described in light of the accompanying drawings.

DETAILED DESCRIPTION OF THE INVENTION

FIGS. 1 to 10 illustrate apparatus for minimizing and maintaining constant the effective blade tip clearance between the outer free ends of rotor blades and an adjacent casing shroud for axial-flow turbines in gas turbine engines.

Figure 1:
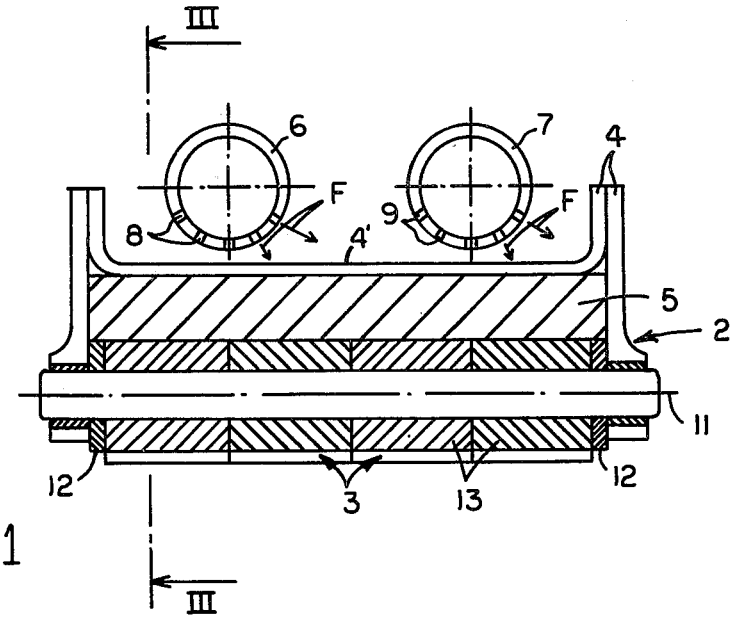
FIG. 1 is an axial sectional view of a casing shroud in accordance with the present invention.
Figure 3:
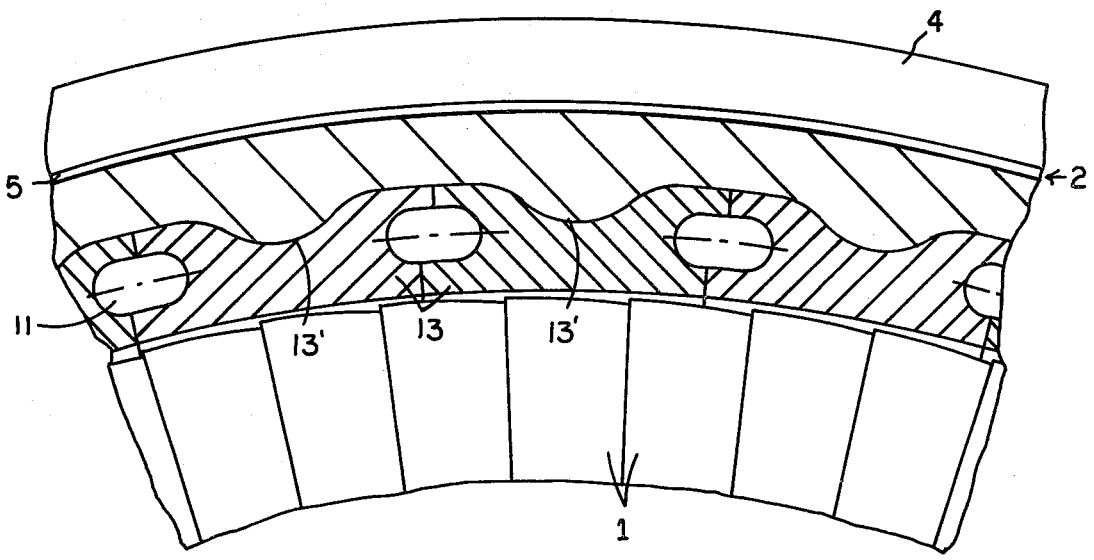
FIG. 3 is a sectional view through the casing shroud taken along line III—III in FIG. 1.

With reference to FIGS. 1 and 3, therein is seen the outer ends of rotor blades 1 (FIG. 3) facing a casing shroud 2 (FIG. 1). The casing shroud 2 in FIG. 1 inwardly faces the hot gas stream and the outer ends of the rotor blades 1 and comprises a packing 3 of high heat resistance ceramic elements 13 also having high erosion resistance. The casing shroud 2 comprises a metal ring 4 in interlocking engagement with the packing 3 of ceramic element 5. A highly efficient, heat-insulative insulator 5 is interposed between the surfaces of the ceramic elements 3 which face away from the rotor blades and the inner surface of metal ring 4. The insulator 5 is essentially completely embedded between the packing 3 and the ring 4. A coaxially extending outer surface 4' of the metal ring 4 can be cooled by blowing compressor bleed air thereagainst for adaption of the expansion of the metal ring to that of the turbine wheel.

The bleed air used to blow against the surface 4' can be tapped at the compressor end of the gas generator, where it is assumed, for example, that the rotor blades 1 associated with the casing shroud 2 belong to the first stage of the compressor turbine. The bleed air tapped at the compressor end flows into two air lines 6,7 arranged coaxially on the casing shroud 2, from where the air is discharged in the direction of arrows F against the surface 4' through selectively spaced ports 8 in the air lines.

Figure 2:
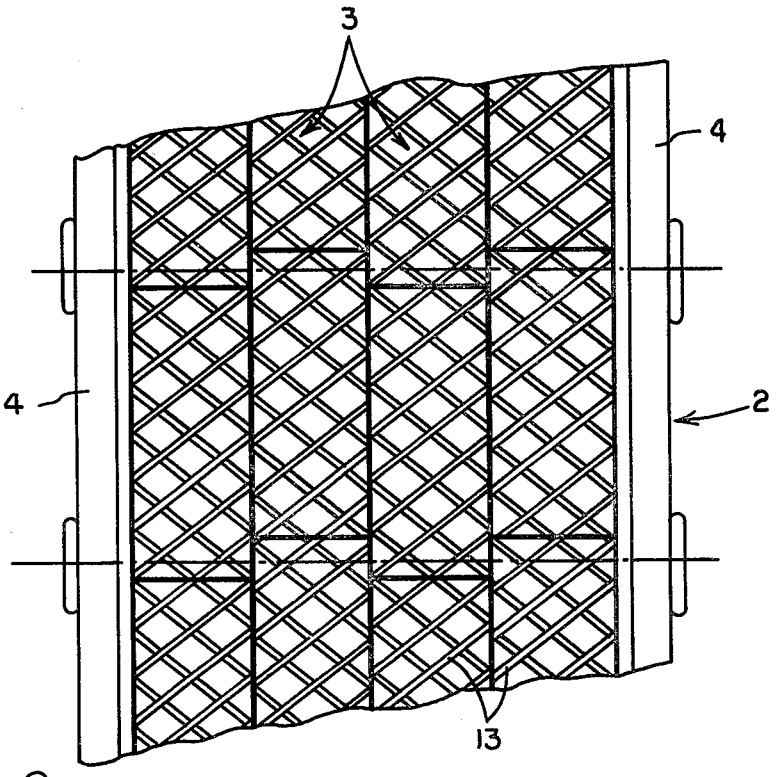
FIG. 2 is a fragmentary plan view of the shroud in FIG. 1.
Figure 4:
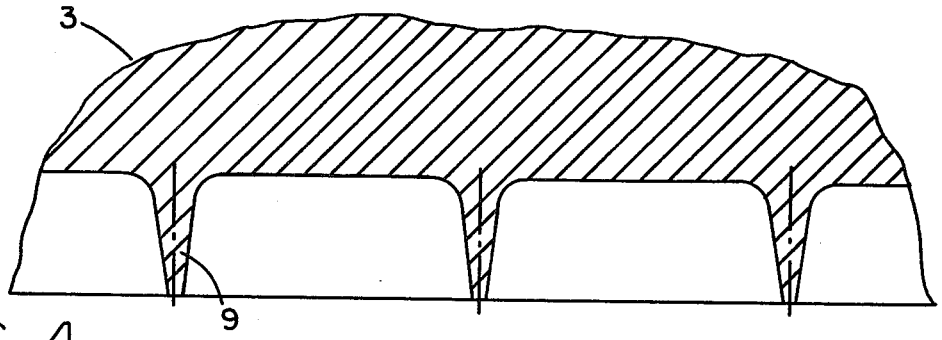
FIG. 4 is an enlarged view of a knife-edged running-in section of the ceramic elements according to a first embodiment.
Figure 5:
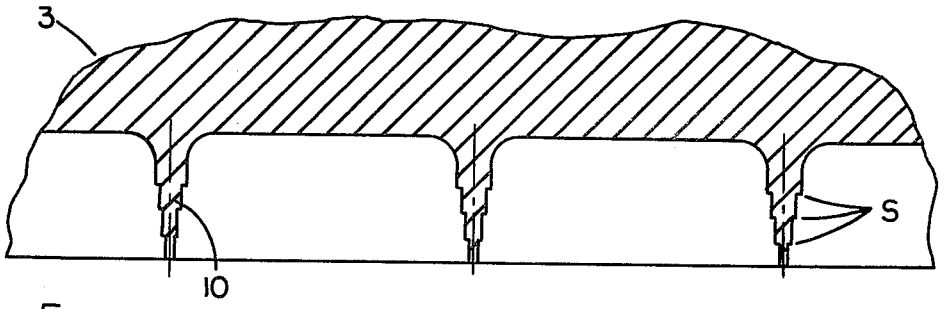
FIG. 5 is an enlarged view of a knife-edged running-in section of the ceramic elements according to a second embodiment.

As it will become apparent especially from FIG. 2, but also from FIGS. 4 and 5, the inner surface of the ceramic element packing 3 which faces the outer ends of the rotor blades has knife-shaped, radially projecting segments or projections 9 or 10. The knife-shaped, radially projecting segments 10 in FIG. 5 are additionally provided with steps S forming shear points to facilitate the severance of the segments thereat without abrasive wear on the rotor blades during running-in.

With reference now to FIGS. 1 and 3, the ceramic element packing 3 can be mounted on the metal ring 4 by means of axially extending pins 11 supported in radially extending arms of the metal ring 4. In order to provide high temperature resistance for the shroud and the associated means, the present invention contemplates that the pins 11 are made from a ceramic material.

With reference to FIG. 1, a highly efficient heat insulator 12 is arranged between the end faces of the extreme elements of packing 3 and the respective adjacent faces of the arms of the metal ring 4.

As will further become apparent from FIGS. 1 and 3, the ceramic elements of packing 3 are composed of annular segments 13 which, as seen in FIG. 3, embrace the pins 11 in interengaged fashion in circumferential abutment areas. The pins 11 are elongated in cross-section and the segments 13 embrace the pins such that the adjacent segments 13 abut one another along faces which are in radially offset planes. The annular segments 13 have curved outer surfaces along their circumferential extent to form recesses 13' facing the insulator 5.

In the assembled condition the abutment faces of adjacent annular segments 13 are not only staggered radially as seen in FIG. 3, but axially as well as seen in FIG. 2.

Figure 6:
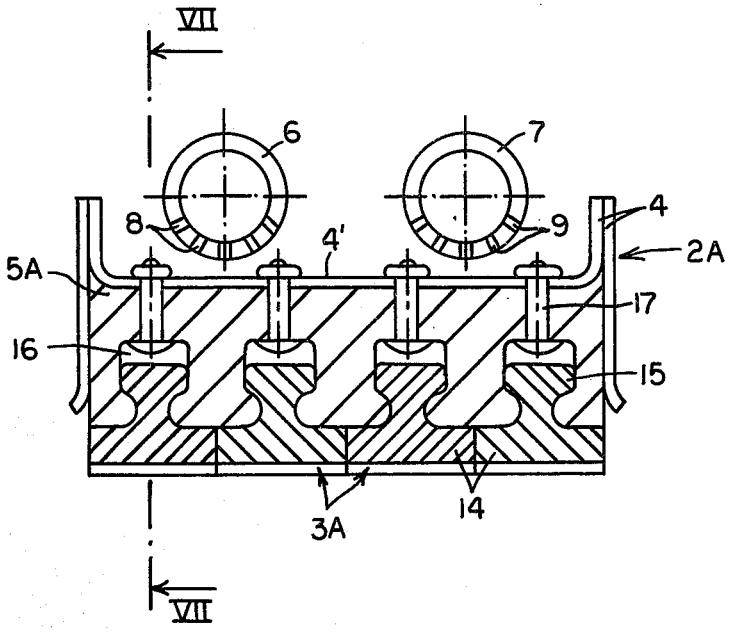
FIG. 6 is an axial sectional view of a casing shroud according to a second embodiment.
Figure 7:
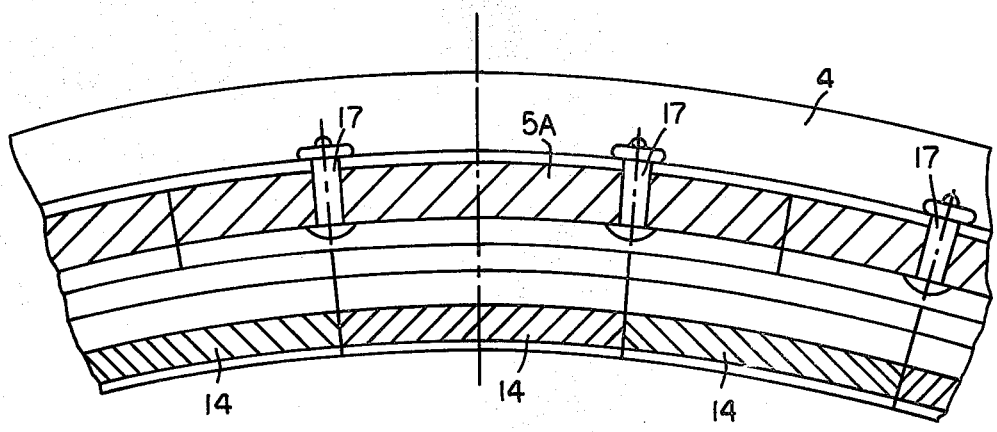
FIG. 7 is a sectional view of the casing shroud as taken along line VII—VII in FIG. 6.

Using the same reference numerals for essentially the same components and appropriate suffixes for modified components, FIGS. 6 and 7 illustrate a further embodiment of the casing shroud 2A where the annular segments 14 of a ceramic packing 3A have root portions 15 of hammer-head shape engaged in circumferentially extending slots 16 in the insulator 5A. As seen in FIG. 6 the circumferentially extending slots 16 are radially extended to accommodate connectors 17 which can be bolts, rivets, screws or the like, which connect the insulator 5A with the coaxially extending wall 4' of the metal ring 4. For optimum compensation of thermal stresses and distortions, the insulator 5A is formed, as illustrated in FIG. 7, by successive circumferential segments. The faces of adjacent segments of insulator 5A are radially offset so that there is interlocking of the adjacent segments.

Figure 8:
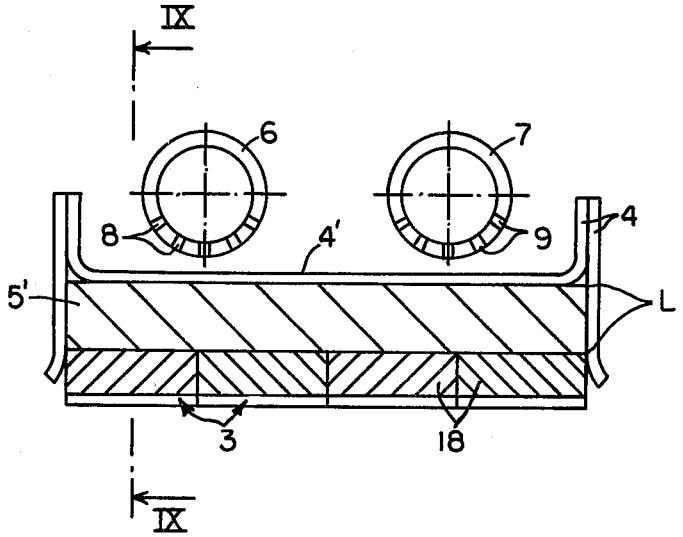
FIG. 8 is an axial sectional view of a casing shroud according to a third embodiment.
Figure 9:
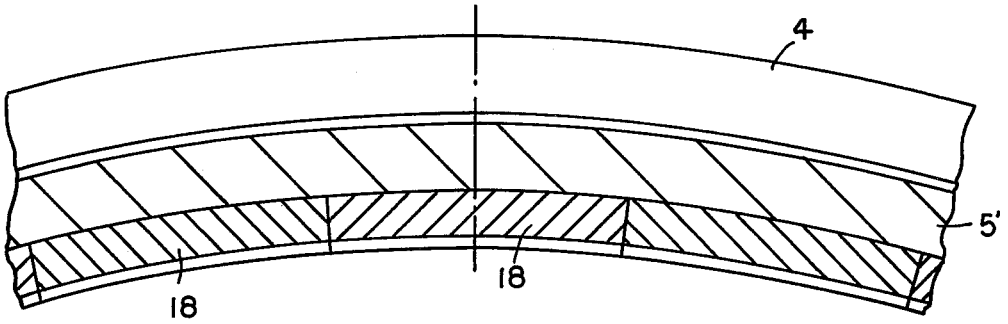
FIG. 9 is a sectional view taken along line IX—IX in FIG. 8.

In a further embodiment of casing shroud as shown in FIGS. 8 and 9, the insulator 5' is made from a metal fabric or a metal felt and the insulator 5' is brazed to the inner surface of wall 4' of the metal ring 4 while the ceramic annular segments 18 are brazed to the insulator 5', the brazing being shown at joints L. At least one of the two brazing joints, however, can be replaced with a bonded joint. The insulator 5' will then be continuous and not segmented as shown in FIG. 9.

Figure 10:
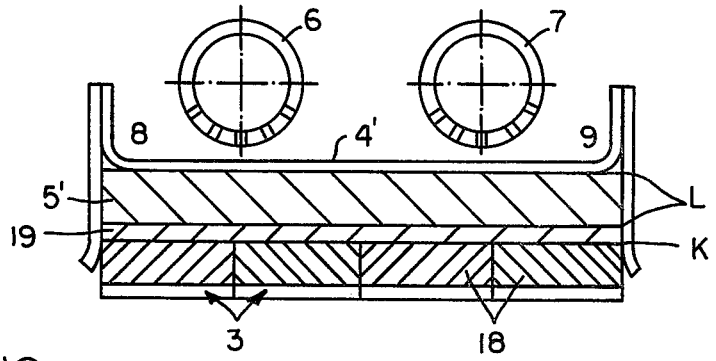
FIG. 10 is an axial sectional view of a casing shroud according to a fourth embodiment.

FIG. 10 differs from FIGS. 8 and 9 solely in that the ceramic annular segments 18 are joined to the metal fabric or metal felt insulator 5' through an intervening, additional, high efficiency heat insulation layer 19, the ceramic annular segments 18 being joined to the thermal insulation layer 19 by bonding along faces K.

The construction of the casing shroud and the associated means of the present invention is applicable to turbojet engines as well as to all other types to turbomachines incorporating axial-flow turbines energized by hot gas.

Hereafter are listed exemplary materials for the particular elements of the casing shroud of the present invention.

| COMPONENT | MATERIAL |
|---|---|
| Metal ring 4 | Inconel 718 |
| Insulator 5 | $SiO_2 + Al_2O_3$ |
| Ceramic elements of packing 3 | Sintered silicon carbide |
| Metal fabric or felt 5' | Inconel X 750 |
| Heat insulation layer 19 | $ZrO_2$ |

What is claimed is:

1. Apparatus for the outer shrouding of the outer free ends of rotor blades of a turbine wheel of an axial-flow turbine of a gas turbine engine, comprising a stationary casing shroud including a packing of high heat-resistance, high erosion-resistance ceramic elements facing outer rotor blade ends and the hot gas stream of the turbine, a metal ring to which said ceramic elements are secured, heat insulator means interposed between said packing and said metal ring, and means for blowing cooling fluid against said metal ring on the side thereof remote from said insulator means for equalizing the expansion of the metal ring to that of the turbine wheel, said ceramic packing comprising a portion facing the outer ends of the rotor blades which includes knife-like, radially projecting segments extending towards said rotor blades and means defining shear points on said segments for breakage of said segments at said shear points upon contact with said rotor blades.

2. Apparatus as claimed in claim 1 comprising axially extending pins secured to said ring, said ceramic elements being supported on said pins.

3. Apparatus as claimed in claim 2 wherein said pins are made of a ceramic material.

4. Apparatus as claimed in claim 1 comprising heat insulator means arranged between the ceramic elements and said metal ring.

5. Apparatus as claimed in claim 1 wherein said ceramic elements are composed of annular segments.

6. Apparatus as claimed in claim 5 wherein said annular segments are provided with recesses facing said insulator means.

7. Apparatus as claimed in claim 6 comprising axially extending pins supported by said ring and arranged circumferentially thereof, said annular segments embracing said pins.

8. Apparatus as claimed in claim 7 wherein adjacent segments abut one other and cooperatively embrace a respective one of said pins, said adjacent segments having abutting radial surfaces which are staggered radially and axially.

9. Apparatus as claimed in claim 1 wherein said insulator means is provided with circumferentially extending slots, said ceramic elements being composed of annular segments having respective root portions of hammer-head shape inserted in said slots in the insulator means.

10. Apparatus as claimed in claim 9 comprising fastener means securing said ring to said insulator means, said slots in said insulator means accomodating said fastener means.

11. Apparatus as claimed in claim 1 wherein said insulator means comprises a plurality of circumferentially successive segments.

12. Apparatus as claimed in claim 1 wherein said insulator means is made from a metal fabric or metal felt, said insulator means being joined to the metal ring and to the ceramic annular segments.

13. Apparatus as claimed in claim 12 wherein the joinder of the insulator means to the ring and ceramic segments is by at least one of brazing or bonding.

14. Apparatus as claimed in claim 1 comprising an intermediate heat insulating layer interposed between and joining said ceramic segments and said insulator means together.

15. Apparatus as claimed in claim 1 comprising at least one perforated coaxially extending air line around said casing shroud for selectively blowing air against said metal ring.

16. A method for minimizing and maintaining substantially constant the blade tip clearance between the outer free ends of rotor blades and a stationary casing shroud of an axial flow turbine of a gas turbine engine, said method comprising mounting on the shroud a packing of ceramic material in facing relation to the free ends of the rotor blades, interposing a heat insulator between the packing and a metal ring secured to the shroud to block heat transfer from the packing to the shroud, blowing cooling fluid against the metal ring to equalize expansion of the ring and the turbine rotor, and forming the packing with knife-like segments projecting radially towards the blades and provided with steps establishing breakage zones such that said segments are broken off at said breakage zones when contacting said blades without producing abrasive damage to the blades.

17. A method as claimed in claim 16 comprising blocking heat transfer from said packing to said metal ring.

18. Apparatus as claimed in claim 1 wherein said shear points are formed as steps on said radially projecting segments to provide stepwise increase of thickness along said segments in a direction away from said blades, said steps defining breakage points for the radially projecting segments.

19. Apparatus as claimed in claim 6 wherein said annular segments respectively include said knife-like radially projecting segments in intersecting sets.

20. Apparatus as claimed in claim 18 wherein said knife-like radially projecting segments are arranged in intersecting sets extending obliquely relative to the axis of rotation of the turbine wheel.

* * * * *